US005400593A

United States Patent [19]

Gelbein et al.

[11] Patent Number: 5,400,593

[45] Date of Patent: Mar. 28, 1995

[54] DEVICE FOR REDUCING DISCHARGE OF NOXIOUS SUBSTANCES EMITTED FROM AN INTERNAL COMBUSTION ENGINE

[76] Inventors: Abraham P. Gelbein, 5501 Seminary Rd., Falls CHurch, Va. 22041; Richard S. Wellens, Box 7, 1000 Water St. SW., Washington, D.C. 20024

[21] Appl. No.: 165,033

[22] Filed: Dec. 9, 1993

[51] Int. Cl.[6] ..... F01N 3/20

[52] U.S. Cl. ..... 60/288; 60/295; 60/297; 60/311; 60/317

[58] Field of Search ..... 60/274, 287, 288, 295, 60/297, 310, 311, 317, 324

[56] References Cited

U.S. PATENT DOCUMENTS

| | | | |
|---|---|---|---|
| 3,757,521 | 9/1973 | Tourtellotte | 60/297 |
| 4,402,714 | 9/1983 | Fethke | 60/311 |
| 5,307,627 | 5/1994 | Christensen | 60/297 |

*Primary Examiner*—Ira S. Lazarus
*Assistant Examiner*—Daniel J. O'3 Connor
*Attorney, Agent, or Firm*—Darby & Darby

[57] ABSTRACT

An apparatus and method suitable in controlling a level of noxious fumes and visible smoke discharging from diesel engine exhaust gases. In a purification mode, a stream of relatively dirty exhaust gases and discharged cooling liquid from the engine are mixed together; liquid entrained in the mixture and particulate matter in the mixture are then removed and noxious substances in the resulting exhaust gases are adsorbed. In a regeneration mode, the exhaust gas is relatively clean so that streams are kept apart to avoid mixing so that the exhaust gases can adsorb the previously adsorbed noxious substances. The purification mode arises when the marine diesel engine is running at slow speed and combustion takes place inefficiently. The regeneration mode arises when the marine engine is running at high speed and combustion takes place efficiently or else noxious substances have been adsorbed substantially to capacity.

16 Claims, 1 Drawing Sheet

DEVICE FOR REDUCING DISCHARGE OF NOXIOUS SUBSTANCES EMITTED FROM AN INTERNAL COMBUSTION ENGINE

BACKGROUND OF THE INVENTION

The present invention relates to a device for reducing discharge of noxious substances emitted from an internal combustion engine.

Marine diesel engines emit exhaust gases and utilize a closed circuit cooling system which uses once through sea water to take away the heat of the engine. The thus heated sea water is introduced as a stream into engine exhaust piping, which is downstream of the engine. This stream of heated sea water is discharged together with a stream of hot exhaust gases which contain noxious fumes. The two streams remain essentially unmixed, retaining their own respective temperatures while flowing through the engine exhaust piping.

Vessels with marine diesel engines share a common problem in that the noxious fumes from the exhaust emissions reach people aboard and in the vicinity of the vessel; this problem is most pronounced when wind currents carry the exhaust fumes back onto the deck at start up or when the vessel docks or moves about slowly. In addition to being unpleasant, noxious fumes contain solid and liquid particulates and volatile hydrocarbons from partially combusted diesel oil fuel. Fortunately, when the marine diesel engine is under significant load, such as when the vessel is travelling at a relatively rapid speed, the engine runs hotter and the combustion of the fuel is more complete. The exhaust produced is less obnoxious and, because the vessel is moving at a more rapid rate, the fumes are less likely to be troublesome to the people on board.

SUMMARY OF THE INVENTION

The present invention is directed to an apparatus and method of reducing discharge of noxious substances emitted from an internal combustion engine for minimizing the noxious effect of exhaust gases. When in a purification mode, the apparatus cools hot exhaust gases with a cooling liquid, separates the liquid from the cooled exhaust gas, and subjects the cooled exhaust gas to an adsorbent, which adsorbs the noxious substances in the gas. During this mode, noxious substances from the internal combustion engine are highest due to inefficient combustion (e.g., when the engine is running "cold" at low engine speeds). In the regeneration mode, the apparatus separates the hot exhaust gases from the cooling liquid and subjects the hot exhaust gas to the adsorbent, which releases the noxious substances to the gas. During this mode, noxious substances from the internal combustion engine are lowest due to efficient combustion (e.g., when the engine is running "hot" at high engine speeds). The rapidly moving vessel leaves this exhaust and the released noxious substances far behind.

The invention is directed to a method of reducing discharge of noxious substances emitted from an internal combustion engine and an apparatus for carrying out the method, the apparatus comprising:

a. inlet means for receiving a hot exhaust gas and cooling liquid;

b. flow control means for directing the hot exhaust gas and cooling liquid to a mixing zone when the apparatus operates in a purification mode and for separating at least a portion of the hot exhaust gas from the cooling liquid when the apparatus operates in a regeneration mode;

c. a mixing zone;

d. a separation zone;

e. a purification zone adapted to contain an adsorbent material which is capable of adsorbing the noxious substances when the apparatus is in the purification mode and of releasing the noxious substances when the apparatus is in the regeneration mode;

f. a liquid receiving zone; and g. an outlet zone;

wherein, when the apparatus is in the purification mode:

the mixing zone is adapted to turbulently admix the exhaust gas and the cooling liquid received from the flow control means so as to cool the exhaust gas;

the separation zone is adapted to receive the admixture from the mixing zone and to separate the liquid from the cooled exhaust gas;

the liquid receiving zone is adapted to receive liquid from the separation zone;

the purification zone is adapted to receive the cooled and separated exhaust gas from the separation zone; and wherein, when the apparatus is in the regeneration mode:

the purification zone is adapted to receive the separated exhaust gas from the flow control means; and wherein the outlet means is adapted to receive the effluents from the purification zone and the liquid receiving zone for discharge from the apparatus.

BRIEF DESCRIPTION OF THE DRAWINGS

For a better understanding of the present invention, reference is made to the following description and accompanying drawings.

DESCRIPTION OF THE PREFERRED EMBODIMENT

Figure 1:
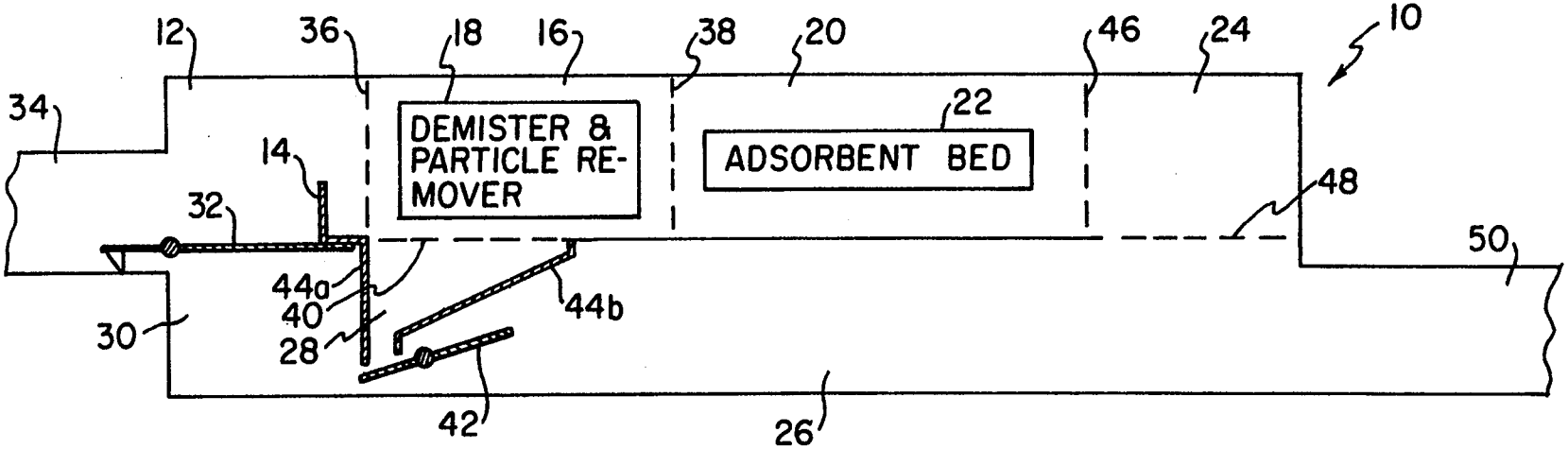
FIG. 1 shows a schematic diagram of an emission control device in a low gas flow mode (i.e., the purification mode) according to the present invention. Noxious substances in the exhaust are scrubbed and adsorbed.
Figure 2:
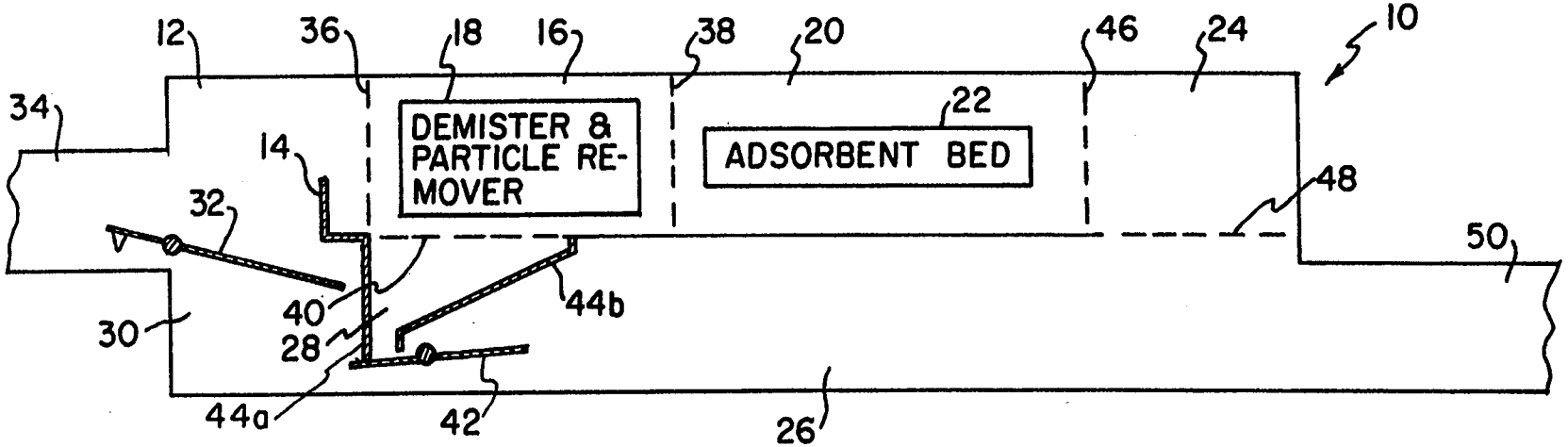
FIG. 2 shows a schematic diagram of an emission control device in a high gas flow mode (i.e., the regeneration mode) according to the present invention. The adsorbed or retained noxious substances are stripped away by and discharged with the gas.

FIGS. 1 and 2 illustrate the inventive device having a housing 10 with seven chambers in fluid communication with each other: a mixing chamber 12 with a baffle 14, a separator chamber 16 with a demister and particle remover 18, a purification chamber 20 with a solid particulate adsorbent bed 22, a discharge chamber 24, a collector chamber 26, a water collection zone 28 and an antechamber 30. The housing 10 can be of any convenient shape, such as elliptical or cylindrical and is generally longitudinally disposed. At the entrance to the mixing chamber is a flow control means such as a butterfly valve 32, whose relative position determines which of two modes the device will be operating.

Upstream of valve 32 is inlet line 34, adapted to carry both exhaust gases and discharging cooling water from the marine diesel engine (not shown). The demister and particle remover 18, which may be a stainless steel mat which removes droplets of water entrained in the gas/-liquid mixture passing through, is bounded by a porous support plate 36 between the mixing and separator chambers and a uniform distribution perforated plate 38 between the separator and purification chambers. A perforated plate or screen 40 lies between the separator chamber and water collection zone.

A second butterfly valve 42, movable between an open position and a closed position, seals the water collection zone 28 in its closed position. The water collection zone 28 is also bounded by sidewalls 44*a*, 44*b* which extend downwardly from either end of the perforated plate or screen 40. When a sufficient amount of water collects in the zone 28, the second butterfly valve 42 opens and the collected water falls into the collector chamber 26 by gravity for discharge and thereby avoids backing up into the separator chamber 16. This valve 42 opens when the height of the collected water in the water collection zone 28 exceeds a predetermined value.

The solid particulate adsorbent bed 22 is bounded between the perforated plates 38 and 46; these plates are preferably configured so that the gas flow entering and leaving the purification chamber 20 is uniform therethrough. The gas leaving the purification chamber 20 passes through the discharge chamber 24 before passing through another perforated plate or screen 48 to reach the collector chamber 26. The collector chamber 26 has a discharge conduit 50 for discharging into the surrounding environment.

Under low load conditions, fuel consumption is low and consequently the amount of exhaust gas generated is relatively low. The valve 32 is shown in FIG. 1 in a closed position, characteristic of a low gas flow mode. In this closed position, the flow of both the exhaust gas and the water streams will impinge baffle 14, creating turbulence mixing of the gas and water streams. This results in both the cooling of the exhaust gas and some scrubbing of particulate material therefrom. The mixed stream exits the mixing chamber 12 and enters the separator chamber 16, in which the water and solid particles are separated from the gas. The water drains through the bottom of the separator chamber 16 into the water collection zone 28, while the gas passes essentially in its entirety through the distributor plate 38 and then into the purification chamber 20. The water collection zone 28 serves to seal the base of the separator chamber and prevents the exhaust gas from by-passing the adsorbent bed 22. The second butterfly valve 42 opens periodically, i.e., when the water level in the water collection zone 28 reaches a pre-determined height. As a consequence, the water drops out of the water collection zone 28 and into the collector chamber 26, from which it is discharged via the discharge conduit 50.

Noxious substances in the exhaust gas are retained or adsorbed by the bed 22, which may be activated carbon or alumina. The cooled and purified gas exits the purification chamber 20, and passes through the discharge chamber 24, the collector chamber 26, and the discharge conduit 50.

Since the flow rate of gas is relatively low while the engine is running under low load and the gas passages in the demister and particle remover 18 and in the adsorbent bed 22 are relatively unobstructed, the exhaust gases can easily flow through these chambers, avoiding any substantial build-up of pressure in the mixing chamber 12. The valve 32 will stay closed and the purification mode of operation is maintained.

FIG. 2 shows the device in a high gas flow mode configured to regenerate the adsorbent bed. Valve 32 is shown in an "open" position, which arises automatically when the pressure in the mixing chamber 12 reaches a predetermined value. This pressure may be reached during high-speed engine operation or from excessive back pressure from the adsorbent bed (e.g., when clogged).

Under high gas flow load conditions, fuel consumption is high and the amount of exhaust gas generated is relatively high. The exhaust gas is also very hot and a portion is diverted through the bed to strip or desorb the bed 22 of adsorbed noxious substances and thereby regenerate the adsorbent bed 22. Given that the diesel engine runs more efficiently at high speed, the resultant exhaust gases are "cleaner" and serve as a good stripping medium for the removal of the adsorbed noxious substances.

When valve 32 is open, all of the water passes directly into the collector chamber 26. Since the water effectively seals the lower section of the unit, the bulk of the hot exhaust gases pass directly through the mixing chamber 12, the separator chamber 16 and into the purification chamber 20.

Should the amount of exhaust gases generated by the engine be such that they cannot all pass through the upper section of the device, the pressure in the inlet line 34 will increase sufficiently to break the water seal in the lower portion of the device and to allow the excess gas to exit via the collector chamber 26. The pressure drop across the separator chamber 16 and the purification chamber 20 determines the split of the hot exhaust gas stream.

During the high gas flow mode of operation, the temperature of the adsorbent bed 22 in the purification chamber 20 approaches that of the exhaust gas temperature, i.e., upwards of 500° F. At this temperature and with excess oxygen present in the exhaust gas, the noxious compounds previously adsorbed are removed by the stripping action. Since the vessel is moving at high speed, the desorbed gases are rapidly dissipated and pose no nuisance to those aboard the vessel.

The change in operational state from a low gas flow mode to a high gas flow mode and vice versa occurs automatically and is dependent on the pressure of the exhaust gas stream in the mixing chamber 12. The pressure in mixing chamber 12 varies with the amount of solid build-up in chambers 16 and 20 and with the flow rate of gas through these chambers. Valve 32 opens or closes depending upon the pressure differential between the mixing chamber 12 and the antechamber 30.

If desired, the opening and closing of valve 32 can be related to the speed of the vessel. At relatively low speeds, valve 32 remains closed, which permits the adsorbent bed to adsorb the noxious substances. Once the vessel reaches a predetermined speed, however, valve 32 opens to permit the regeneration of the particle adsorbent bed 22. A pressure sensor may be advantageously employed to sense an excessive build-up of pressure within the device. Such a pressure build-up may be caused by the blockage of the gas passages in the separator chamber 16 and the purification chamber 20 when the system is not adequately desorbed because, for example, of extended travel of the vessel at low speeds. As noted above, when the pressure within the apparatus exceeds a predetermined value, valve 32 is opened. This also serves as a safety measure by preventing excessive pressure build-up. Preferably, a flow control element, such as a valve, which is responsive to at least one of a pressure differential across the element, a change in engine speed, combustion efficiencies of the engine, and a build-up of noxious substances in the purification zone may be used for periodically alternating between the purification mode and the regeneration mode.

In addition, a catalytic converter may be positioned downstream in series with the apparatus of the present invention. The converter serves to further remove noxious materials from marine diesel exhaust. The present invention reduces the contamination and plugging of the catalytic converter bed arising from solid particulates in the exhaust. A further advantage is that the device itself will serve to muffle the considerable noise of the diesel engine while providing exhaust gas purification.

For example, when a 200 BHP engine is used, exhaust gas and cooling water preferably enter the device through a common six inch diameter conduit and exit through a common six inch conduit. The cross-sectional area (in the flow direction) of the upper section preferably is 1 square foot and of the lower section 0.5 square feet. The preferred length of the demister pad is six inches and the carbon bed is one foot. The valve 32 is designed to open at a pressure drop of 12 inches water. This is the pressure drop that occurs across the demister pad and carbon bed at a gas velocity of 1 foot per second which corresponds to 60 cubic feet per minute (60° F., 1 atmosphere pressure) of exhaust gas.

Under idle and low load conditions, fuel bum is in the range of 0.5 gallons per hour. Approximately 50 cubic feet per minute of exhaust gas is produced at a temperature of 500° F. The cooling water rate is about 30 gallons per minute. All the exhaust gas is cooled to near sea water temperature (range of 80° F.) and pass through the carbon bed.

At full load conditions, the fuel bum rate is in the range of seven gallons per hour, the exhaust gas rate is approximately 1000 cubic feet per minute at 800° F., and the cooling water rate is about 60 gallons per minute. The valve 32 opens and the hot exhaust gas (500°–800° F.) is distributed between the upper and lower sections of the device with 10% passing through the carbon bed. Accordingly, if the boat operates for 1 hour under full load, approximately 6000 cubic feet of hot gas will pass through and regenerate the carbon bed. The one cubic foot of carbon contained in this size unit has sufficient adsorbent capacity to clean-up the exhaust gas from the combustion of approximately 50 gallons of diesel fuel in between regeneration cycles.

While the foregoing description and drawings represent the preferred embodiments of the present invention, it will be understood that various changes and modifications may be made without departing from the spirit and scope of the present invention.

What is claimed is:

1. An apparatus for reducing a discharge of noxious substances emitted from an internal combustion engine, which comprises:

a. inlet means for receiving a hot exhaust gas and cooling liquid;

b. flow control means for directing said hot exhaust gas and cooling liquid to a mixing zone when said apparatus operates in a purification mode and for separating at least a portion of said hot exhaust gas from said cooling liquid when said apparatus operates in a regeneration mode;

c. a mixing zone;

d. a separation zone;

e. a purification zone adapted to contain an adsorbent material which is capable of adsorbing the noxious substances when the apparatus is in the purification mode and of releasing the noxious substances when the apparatus is in the regeneration mode;

f. a liquid receiving zone; and g. an outlet zone;

wherein, when the apparatus is in the purification mode:

the mixing zone is adapted to turbulently admix the exhaust gas and the cooling liquid received from the flow control means so as to cool the exhaust gas;

the separation zone is adapted to receive the admixture from said mixing zone and to separate the liquid from said cooled exhaust gas;

the liquid receiving zone is adapted to receive liquid from said separation zone;

the purification zone is adapted to receive the cooled and separated exhaust gas from the separation zone; and wherein, when the apparatus is in the regeneration mode:

the purification zone is adapted to receive the separated exhaust gas from said flow control means; and wherein said outlet means is adapted to receive the effluents from said purification zone and said liquid receiving zone for discharge from said apparatus.

2. An apparatus as in claim 1, further comprising additional mixing means upstream of said outlet means for admixing the effluents.

3. An apparatus as in claim 1, wherein said flow control means is adapted for periodically alternating operation between said purification mode and said regeneration mode.

4. An apparatus as in claim 1, wherein said flow control means includes a flow control element responsive to at least one of a pressure differential across said element, a change in engine speed, combustion efficiencies of said engine and a build-up of noxious substances in said purification zone for periodically alternating between said purification mode and said regeneration mode.

5. An apparatus as in claim 1, wherein said flow control means includes a flow control element and sensor means for sensing at least one of a pressure differential across said element, a change in engine speed, combustion efficiencies of said engine and a build-up of noxious substances in said purification zone, said flow control element periodically alternating between said purification mode and said regeneration mode based on what is sensed by said sensing means.

6. An apparatus as in claim 1, further comprising means for preventing the cooled exhaust gas from bypassing said purification zone after passing through said separator zone.

7. An apparatus as in claim 6, wherein said preventing means is interposed between said separator zone and said liquid receiving zone.

8. An apparatus as in claim 7, wherein said preventing means includes means for retaining an accumulation of the separated cooling liquid and valve means for periodically discharging said accumulation into said liquid discharge zone.

9. An apparatus as in claim 1, wherein said purification zone contains said adsorbent material which adsorbs the noxious substances when the apparatus is in said purification mode and which releases the noxious substances by desorption when the apparatus is in said regeneration mode.

10. An apparatus for reducing a discharge of noxious substances emitted from an internal combustion engine, the apparatus comprising:

sensor means for determining a purification or a regeneration mode of flow through said apparatus;

an inlet for receiving hot exhaust gas and cooling liquid from said engine;

a mixing chamber contiguous to said inlet means;

flow control means between said inlet and said mixing chamber responsive to said sensor means for allowing the cooling liquid and the hot exhaust gas to enter said mixing chamber when said purification mode is selected and for diverting said cooling liquid from said mixing chamber when said regeneration mode is selected;

means within said mixing chamber for turbulently mixing together said hot exhaust gas and said cooling liquid so as to cool and scrub the hot exhaust gas;

separation means for removing the liquid and particulate matter from said cooled exhaust gas; and adsorbent means for receiving the cooled exhaust gas and for adsorbing noxious substances present therein when said purification mode is selected and for receiving the hot exhaust gas when the regeneration mode is selected, said gas serving to desorb the noxious substances absorbed in said absorbent means.

11. An apparatus as in claim 10, wherein said sensor means selects the applicable mode in response to the pressure in the mixing chamber.

12. An apparatus as in claim 10, wherein said separation means includes a collection chamber for collecting liquid that has been separated from the cooled exhaust gas and includes a seal for selectively opening and closing said collection chamber in response to the amount of liquid in said collection chamber and the pressure in the mixing chamber.

13. An apparatus as in claim 10, wherein said sensing means selects the applicable mode based on at least one of pressure differential across said sensing means, the speed of the engine, combustion efficiencies of the engine, and the build-up of noxious substances in said adsorbent means.

14. An apparatus as in claim 10, wherein said adsorbent means contains activated carbon or alumina.

15. An apparatus for reducing an amount of noxious substances emitted from a liquid cooled internal combustion engine having a purification mode of operation wherein said noxious substances are adsorbed by an adsorbent bed and a regeneration mode of operation wherein the adsorbed noxious substances are desorbed from said adsorbent bed, the apparatus comprising:

means for selectively changing said apparatus from said purification mode to said regeneration mode and vice versa;

a mixing zone;

flow control means responsive to said selectively changing means for passing said hot exhaust gas and discharged cooling liquid from the engine into said mixing zone when said purification mode is selected and for diverting the discharged cooling liquid from entering said mixing zone so substantially only said hot exhaust gas enter said mixing zone when said regeneration mode is selected;

means within said mixing zone for turbulently mixing said hot exhaust gas with the relatively cool discharged cooling liquid so as to cool said hot exhaust gas;

separation means for separating said cooled exhaust gas from said liquid;

an adsorbent bed for adsorbing noxious particles from said cooled exhaust gas when said purification mode is selected; and means for contacting said adsorbent bed with said hot exhaust gas so as to desorb said noxious particles when said regeneration mode is selected.

16. An apparatus for reducing an amount of discharge of noxious substances emitted from a liquid cooled internal combustion engine, comprising:

inlet means for receiving an exhaust gas and cooling liquid;

noxious emission reduction means, downstream of said inlet means, for purifying the exhaust gas with a purification substance during a purification mode and for regenerating the purification substance during a regeneration mode, said noxious emission reduction means directing the flow of the exhaust gas and the cooling liquid from said inlet means when in said purification mode to follow a path through:

a mixing zone downstream of said inlet means for turbulently mixing together the exhaust gas and the cooling liquid so as to cool the exhaust gas; a separator downstream of said mixing zone for removing the liquid from the cooled exhaust gas; a purification zone downstream of said separator for receiving the cooled exhaust gas and separating therefrom noxious substances with the purification substance;

said noxious emission reduction means directing the flow of the exhaust gas when in said regeneration mode to pass through conduit means which guide the flow of the exhaust gas from said inlet means to said purification zone so that the exhaust gas may remove the noxious substances from said purification substance, said noxious emission reduction means directing the flow of the cooling liquid when in said regeneration mode to pass through separation means which diverts the flow of the cooling liquid from said inlet means to prevent said cooling liquid from mixing with the exhaust gas between said inlet means and said purification zone; and outlet means for discharging said flow of exhaust gas and cooling liquid leaving said noxious emission reduction means.

* * * * *